US011078688B2

(12) United States Patent
Parsons et al.

(10) Patent No.: US 11,078,688 B2
(45) Date of Patent: Aug. 3, 2021

(54) PRISONER TRANSPORT KIT

(71) Applicant: Armament Systems and Procedures, Inc., Appleton, WI (US)

(72) Inventors: Kevin Parsons, Appleton, WI (US); Siu Ngai Wang, Kowloon (HK)

(73) Assignee: ARMAMENT SYSTEMS AND PROCEDURES, INC., Appleton, WI (US)

( * ) Notice: Subject to any disclaimer, the term of this patent is extended or adjusted under 35 U.S.C. 154(b) by 316 days.

(21) Appl. No.: 16/231,546

(22) Filed: Dec. 23, 2018

(65) Prior Publication Data

US 2020/0199914 A1 Jun. 25, 2020

(51) Int. Cl.
*E05B 75/00* (2006.01)
*E05B 27/08* (2006.01)

(52) U.S. Cl.
CPC ..... *E05B 75/00* (2013.01)

(58) Field of Classification Search
CPC ..... E05B 75/00; E05B 27/08; E05B 75/005; A61F 5/37; A61F 5/3715; A61F 5/3723; Y10T 24/312; Y10T 24/318; Y10T 24/4084; Y10T 24/4086; Y10T 24/4093; A44B 11/2561; B60R 2022/1812
USPC ... 70/14–19, 30, 49, 58, 403, 404, 491, 496; 59/84–93; 119/816, 818, 819; 128/878, 128/879, 882
See application file for complete search history.

(56) References Cited

U.S. PATENT DOCUMENTS 106,255 A * 8/1870 Clemons
151,452 A * 5/1874 Tower
1,038,492 A * 9/1912 Lorey ..... E05B 75/00 70/16
1,410,802 A * 3/1922 Foster ..... E05B 75/00 70/16
1,500,613 A * 7/1924 Halloway ..... A01K 65/00 224/103
1,674,045 A * 6/1928 James ..... A01K 65/00 224/103
1,823,697 A * 9/1931 Nenstiehl ..... E05B 75/00 70/16
1,921,434 A * 8/1933 Stone ..... B62D 43/007 70/259
2,645,922 A * 7/1953 Martin ..... E05B 75/00 70/16
3,740,977 A * 6/1973 Stefansen ..... E05B 75/00 70/16
4,083,211 A * 4/1978 Scherbing ..... E05B 27/083 70/467
4,114,234 A * 9/1978 Hogenson ..... A45C 7/0045 16/114.1
4,249,401 A * 2/1981 Daleo ..... E05B 75/00 70/16
5,233,848 A * 8/1993 Elam ..... E05B 75/00 70/16
5,613,381 A * 3/1997 Savage ..... E05B 75/00 70/16
5,644,819 A * 7/1997 Lyons ..... B65D 63/08 24/20 R
5,680,781 A * 10/1997 Bonds ..... E05B 75/00 70/16

(Continued)

*Primary Examiner* — Lloyd A Gall
(74) *Attorney, Agent, or Firm* — Hahn Loeser & Parks LLP

(57) ABSTRACT

A prisoner transport kit is described including handcuffs, ankle cuffs, fetters, and locks for use in transporting a prisoner.

24 Claims, 10 Drawing Sheets

(56) References Cited

U.S. PATENT DOCUMENTS

| | | | | |
|---|---|---|---|---|
| 5,732,576 | A * | 3/1998 | Moore | E05B 75/00 128/878 |
| 6,000,249 | A * | 12/1999 | Wilber | E05B 75/00 119/857 |
| 6,360,747 | B1 * | 3/2002 | Velarde | E05B 75/00 128/869 |
| 6,886,374 | B2 * | 5/2005 | Clifton, Jr. | E05B 75/00 70/16 |
| 7,150,141 | B1 * | 12/2006 | Greenway | A44C 11/002 59/1 |
| 7,284,399 | B1 * | 10/2007 | Sisco | E05B 75/00 119/816 |
| 7,437,898 | B2 * | 10/2008 | Su | E05B 67/003 70/14 |
| 7,481,084 | B1 * | 1/2009 | Wu | E05B 67/003 70/18 |
| 2006/0289017 | A1 * | 12/2006 | Schmeltz | A61F 5/3723 128/869 |
| 2012/0006079 | A1 * | 1/2012 | Corbo | E05B 73/0005 70/58 |
| 2014/0060126 | A1 * | 3/2014 | Stevens | E05B 67/36 70/18 |
| 2015/0267439 | A1 * | 9/2015 | Thoonsen | E05B 73/0017 340/572.1 |
| 2016/0130841 | A1 * | 5/2016 | Pala | E05B 67/383 70/431 |
| 2016/0348402 | A1 * | 12/2016 | Barron | E05B 67/003 |
| 2017/0051537 | A1 * | 2/2017 | Wang | E05B 67/003 |

* cited by examiner

PRISONER TRANSPORT KIT

FIELD OF THE INVENTION

The invention generally relates to personal restraints and, in specific examples, to handcuffs, ankle cuffs, fetters, and locks for use in transporting a prisoner.

BACKGROUND AND SUMMARY

Existing methods for transporting prisoners often require compromises between competing requirements of maintaining control of the prisoner and permitting a degree of comfort for the prisoner—particularly in connection with the prisoner eating and attending to other biological needs. The present disclosure of a pair of rigid handcuffs adapted for engagement with the disclosed prisoner transport fetter and the disclosed lock enhance the combination of control and comfort of the prisoner relative to existing methods. The lock provides for ease of connection and disconnection of the handcuffs to or from the fetter, while leaving both in place on the prisoner, or while removing one and leaving the other in place on the prisoner. Similarly, the lock provides for ease of connection and disconnection of ankle cuffs to or from the fetter, while leaving both in place on the prisoner, or while removing one and leaving the other in place on the prisoner. The present disclosure will be of use to police, court marshals, correction officers, and other security officials such as airport security officials.

DETAILED DESCRIPTION

Figure 3:
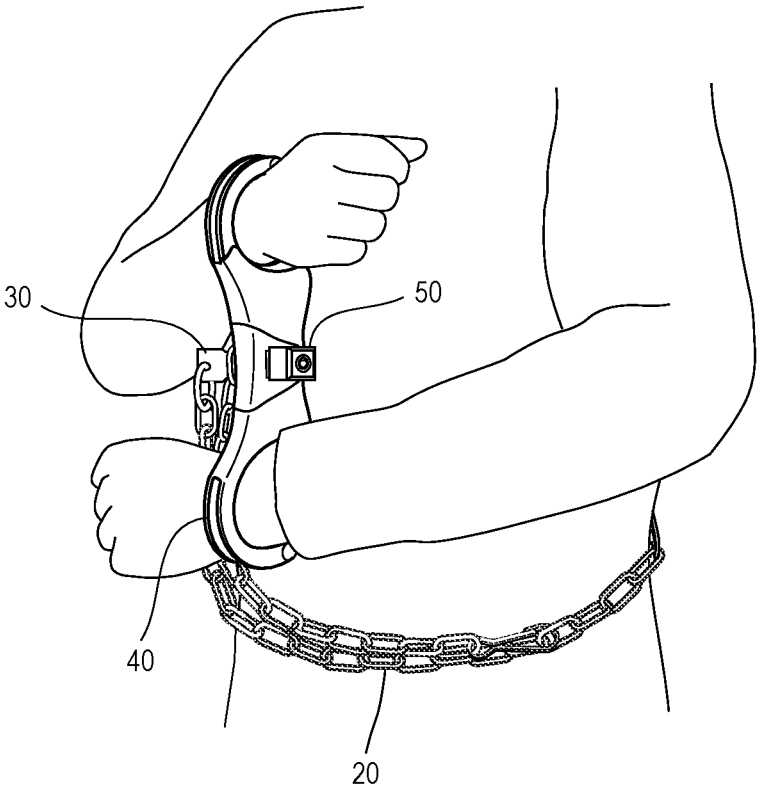
FIG. 3 is an illustration of a disclosed prisoner transport kit in use, with a prisoner fettered and handcuffed.

The disclosed prisoner transport kit may comprise, for example, a prisoner transport fetter 20, a pair of rigid handcuffs 40, and a lock 50. The prisoner transport fetter 20 comprises, for example, a tongue 30 at one end and an attaching mechanism at the other end, with a plurality of fetter openings spaced apart from each other along a length of the prisoner transport fetter 20. In practice, the prisoner is handcuffed, the fetter is encircled around the prisoner's torso with the tongue 30 being inserted through one of the fetter openings selected for an appropriate fit around the prisoner, the tongue 30 is inserted through a channel 44 in the pair of rigid handcuffs 40, and the tongue 30 is inserted a predetermined distance into a lock opening 53 in the lock 50. If the locking mechanism 56 is in the locking position, it then will prevent removal of the tongue 30 from the lock 50. The attaching mechanism can be used to attach the other end of the prisoner transport fetter 20 to one of the fetter openings to encircle the remainder of the prisoner transport fetter 20 around the prisoner if that is preferred. This description of the use of the prisoner transport kit is illustrated in FIG. 3. Arranging the rigid handcuffs 40 as shown in FIG. 3 (prisoner's hands going through the rigid handcuffs 40 in opposite directions) reduces the stress on the wrists, enhances prisoner comfort, and allows the prisoner to attend to certain needs without the rigid handcuffs 40 being unlocked.

Figure 1:
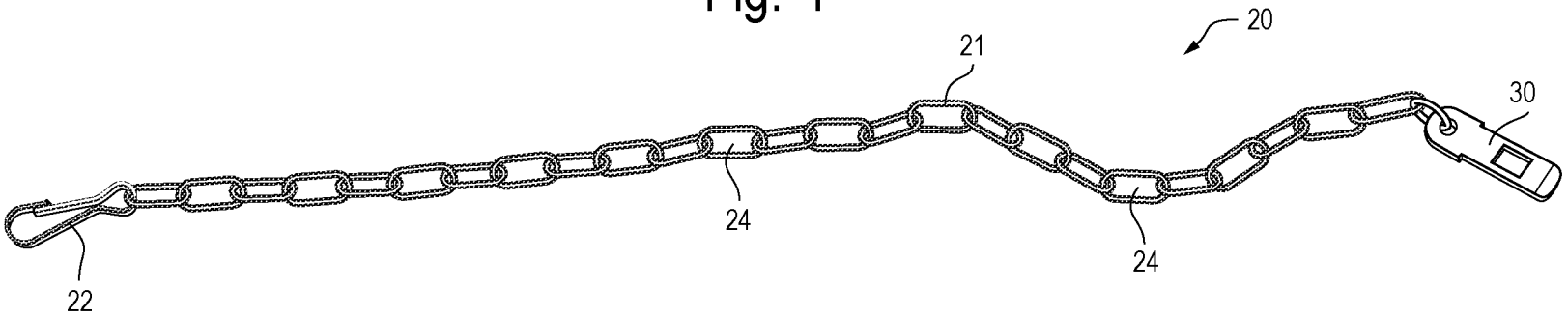
FIG. 1 is a perspective view of one embodiment of the disclosed prisoner transport fetter.

FIG. 1 illustrates one embodiment of the prisoner transport fetter 20. It comprises a chain 21, with a tongue 30 at one end, and a clip 22 at the other end. In use, the chain will encircle the prisoner with the tongue 30 being inserted through one of the chain link openings 24 before being inserted through a pair of rigid handcuffs 40. The excess remainder of the chain 21 also can encircle the prisoner and be attached to one of the chain link openings 24 by the clip 22. In some embodiments, the chain comprises stainless steel.

Figure 2:
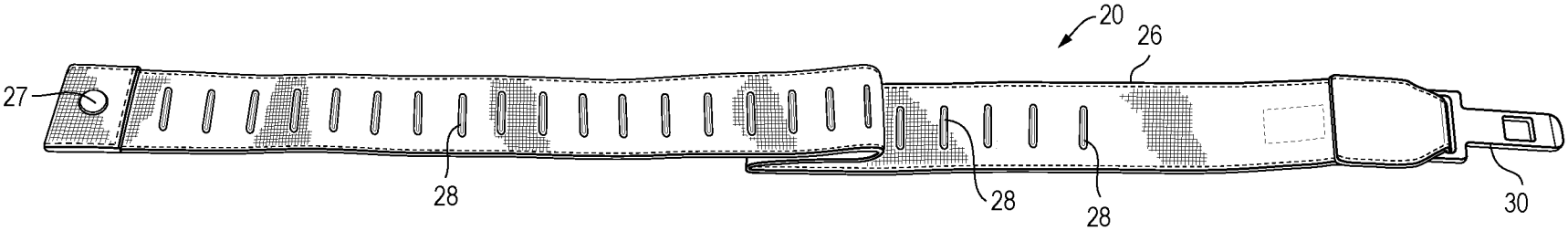
FIG. 2 is a perspective view of a second embodiment of the disclosed prisoner transport fetter.

FIG. 2 illustrates another embodiment of the prisoner transport fetter 20. It comprises a fiber belt 26, with a tongue 30 at one end, a button 27 at the other end, and a plurality of button holes 28 along a length of the fiber belt 26. In use, the fiber belt 26 will encircle the prisoner with the tongue 30 being inserted through one of the button holes 28 before being inserted through a pair of rigid handcuffs 40. The excess remainder of the fiber belt 26 also can encircle the prisoner and be attached to one of the button holes 28 by the button 27.

In some embodiments, the fiber belt 26 comprises a fiber that is light-weight. For example, it may be a polyester webbing. In some examples, it is strongly stretch-resistant, abrasion-resistant, and cut-resistant, by which is meant that the chemical formation of the fiber used in the fiber belt 26 causes any quantifiable measurement of these physical properties to be at least several times greater than would be the case for ordinary fibers. For example, the fiber belt 26 may comprise aramid, which is a manufactured fiber in which the fiber-forming substance is a long-chain synthetic polyamide in which at least 85% of the amide linkages (—CO—NH—) are attached to two aromatic rings. The chain molecules in the fibers are highly oriented along the fiber axis, resulting in the chemical bonds contributing much more strength than is the case with many other synthetic fibers. As another example, the fiber belt 26 may comprise an ultra-high-molecular-weight polyethylene (UHMWPE). The UHMWPE comprises very long chains of polyethylene aligned in the same direction. Because the molecules are very long, they can carry large shear forces from molecule to molecule. In some forms, UHMWPE is said to be 15 times more resistant to abrasion than carbon steel.

Figure 17:
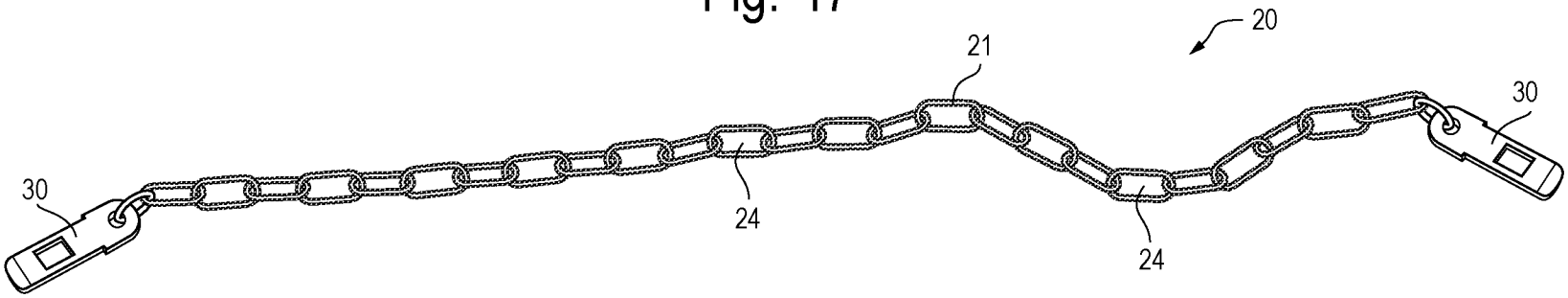
FIG. 17 is a perspective view of a third embodiment of the disclosed prisoner transport fetter.
Figure 18:
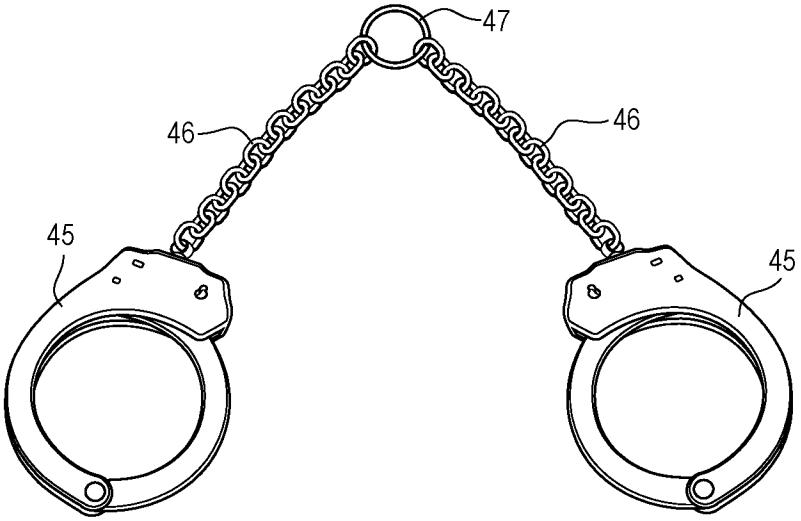
FIG. 18 is a perspective view of a disclosed pair of ankle cuffs.
Figure 19:
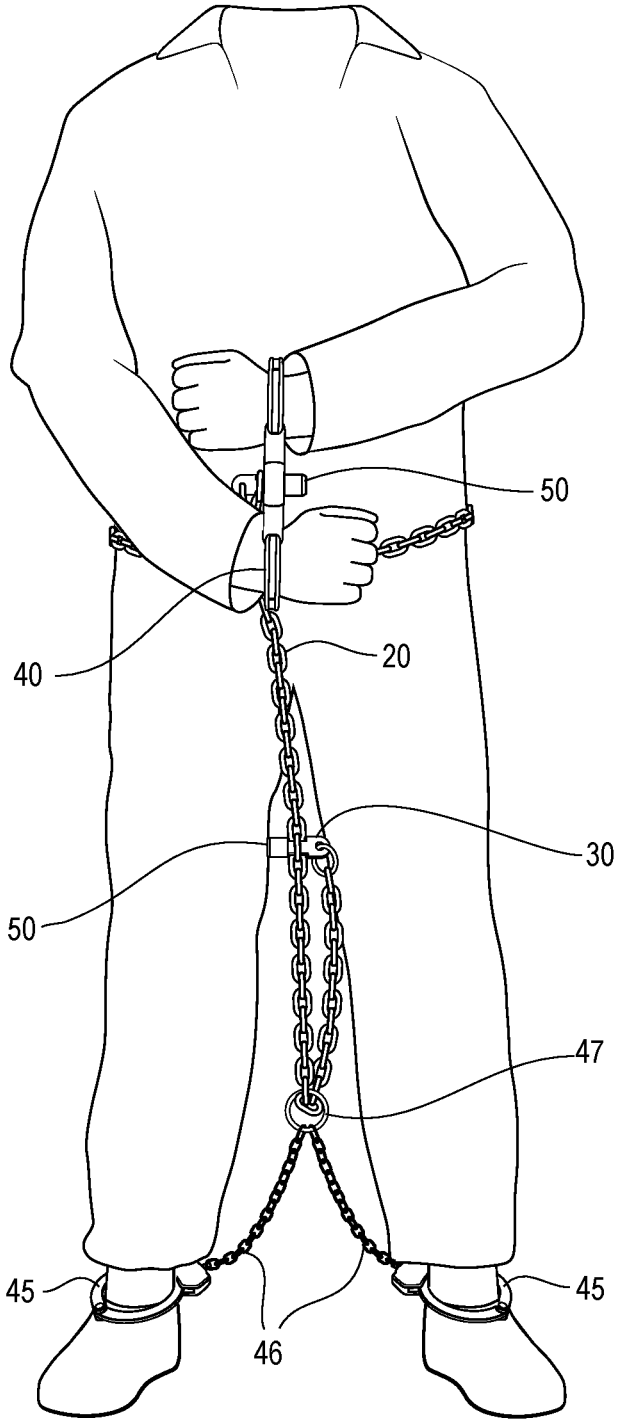
FIG. 19 is an illustration of a disclosed prisoner transport kit in use, with a prisoner fettered, handcuffed, and ankle-cuffed.

FIG. 17 illustrates a third embodiment of the prisoner transport fetter 20. In the illustrated example, it is similar to the embodiment of FIG. 1 except that there are tongues 30 at both ends of chain 21 instead of a clip 22 at one end. In use, the second tongue 30 at the end of the excess remainder of chain 21 can be inserted in another lock 50. For example, with a long enough chain 21, the excess remainder of chain 21 can be passed through a center ring 47 of ankle cuffs 45 and the second tongue 30 can be inserted through one of the chain link openings 24 before being inserted the predetermined distance into a lock opening 53 of a second lock 50. This is illustrated, for example, in FIG. 19. Disclosed ankle cuffs 45 are illustrated, for example, in FIG. 18, where each of two ankle cuffs 45 are connected by a chain 46 to a central ring 47. Passing an end of the fetter 20 through central ring 47 and then locking that end of the fetter 20 to a fetter opening allows connection and disconnection of ankle cuffs 45 to or from the fetter 20, while leaving both in place on the prisoner, or while removing one and leaving the other in place on the prisoner.

Figure 5:
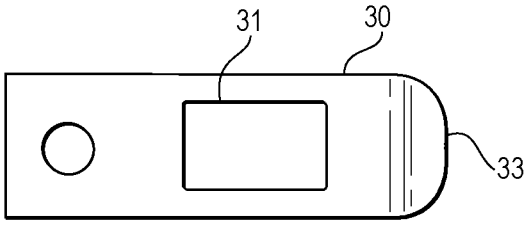
FIG. 5 is a top view of one embodiment of a tongue that would be located at one end of a prisoner transport fetter.
Figure 6:
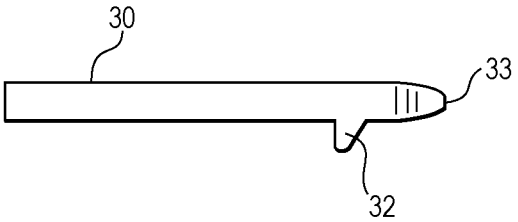
FIG. 6 is a side view of a second embodiment of a tongue that would be located at one end of a prisoner transport fetter.
Figure 14:
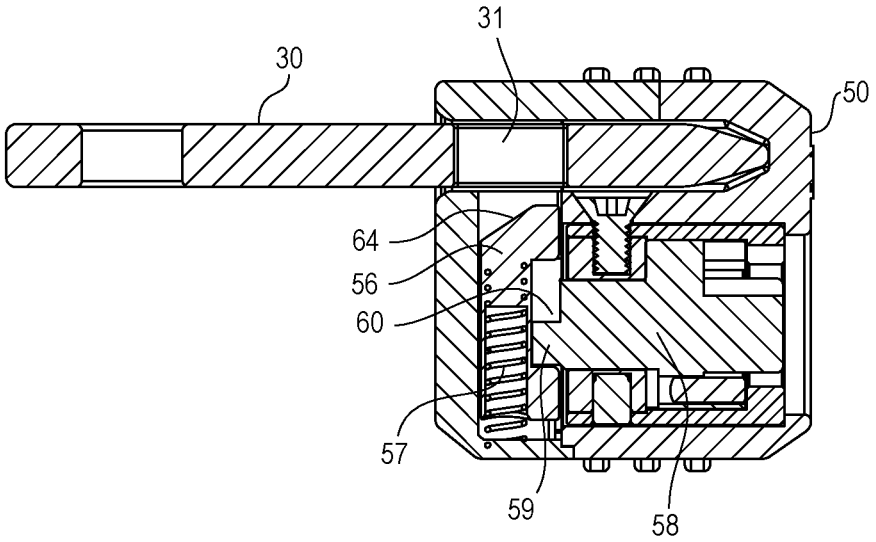
FIG. 14 is a sectional side view taken along 14-14 of FIG. 13, with the locking mechanism away from the locking position.
Figure 15:
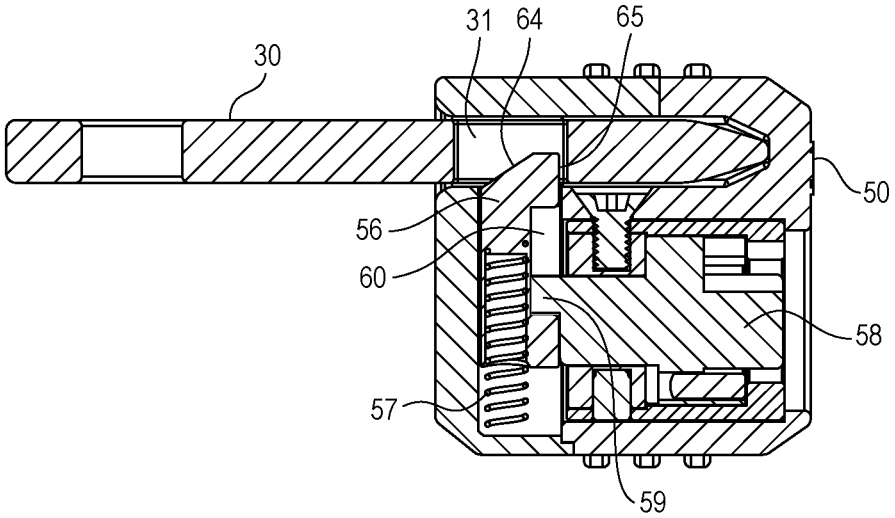
FIG. 15 is a sectional side view taken along 14-14 of FIG. 13, with the locking mechanism in the locking position.
Figure 16:
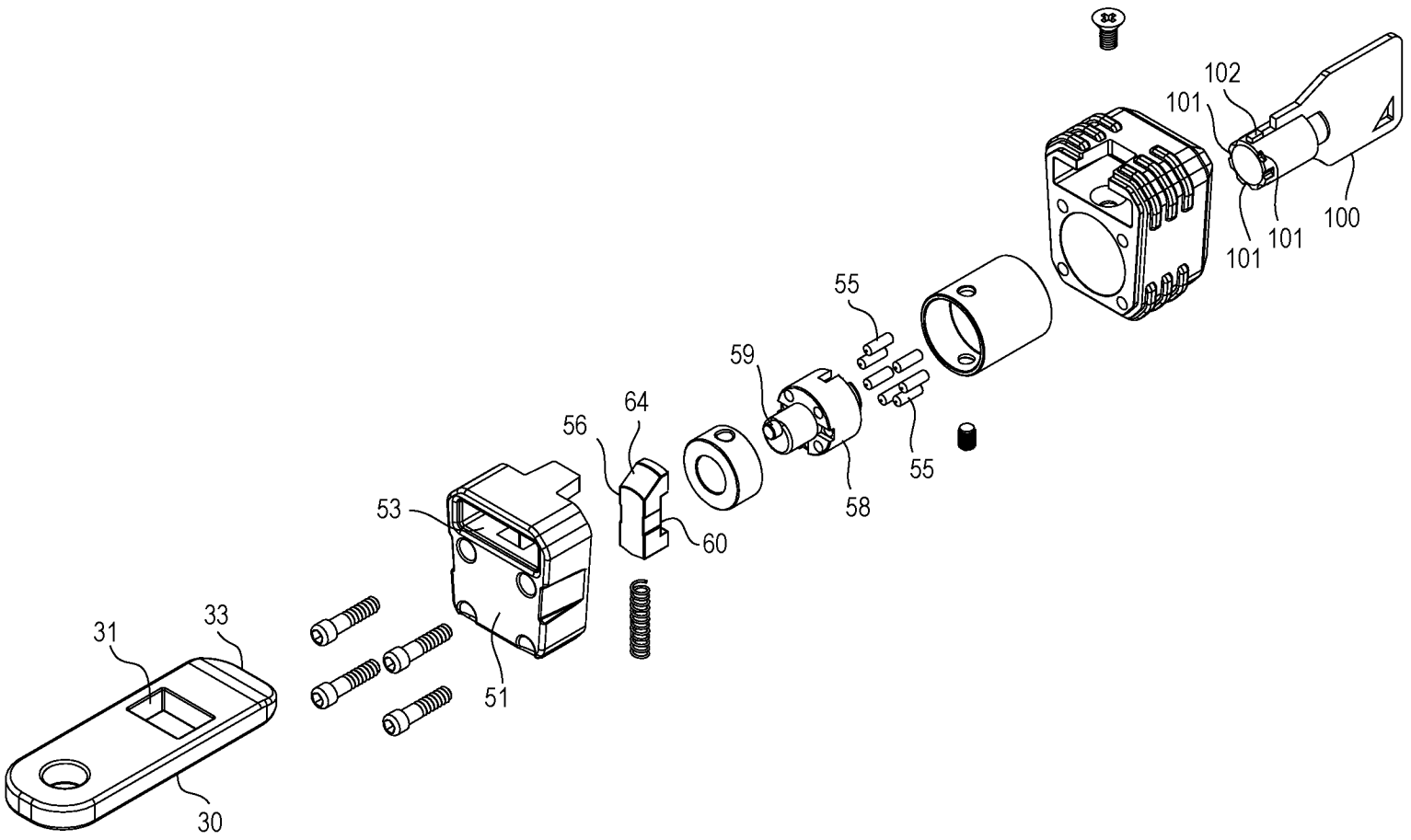
FIG. 16 is an exploded view of the lock, together with a tongue and with a key.

In some embodiments, the tongue 30 comprises a locking feature that engages with the locking mechanism 56 in the lock 50. FIG. 5 is an illustration of an embodiment of the tongue 30 in which the locking feature is an opening 31 in the tongue 30. As seen in FIGS. 14 through 16, a tapered end 33 of the tongue 30 can push down a wedge-shaped end 64 of the spring-biased locking mechanism 56 as the tongue 30 is inserted into the lock opening 53. When the tongue 30 is inserted a predetermined distance, the spring-biased locking mechanism 56 will rise through the opening 31, and a vertical surface 65 of the locking mechanism 56 will prevent removal of the tongue 30 from the lock 50. FIG. 6 is an illustration of an embodiment of the tongue 30 in which the locking feature is a protrusion 32 depending from a remainder of the tongue 30. The protrusion 32 engages with a locking mechanism 56, pushing down wedge-shaped end 64 of the locking mechanism 56 as the tongue 30 is inserted into lock opening 53, until the tongue 30 is inserted a predetermined distance and the spring-biased locking mechanism rises behind protrusion 32 and vertical surface 65 of the locking mechanism 56 prevents removal of the tongue 30 from the lock 50.

Figure 4:
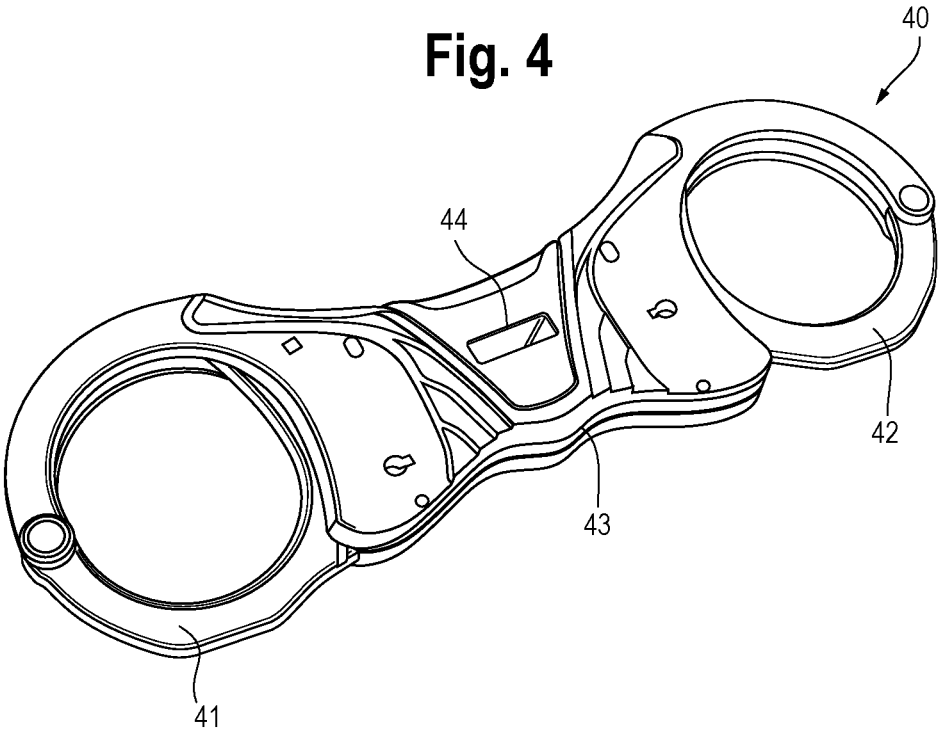
FIG. 4 is a perspective view of a disclosed pair of rigid handcuffs.

FIG. 4 illustrates an example of a pair of rigid handcuffs 40, comprising right and left handcuffs 41 and 42, and a middle section 43 that joins right and left handcuffs 41 and 42 so that they are not movable relative to each other. The middle section 43 defines a channel 44 that is dimensioned to allow tongue 30 to pass through the channel 44, but not to allow a lock 50 to pass through the channel 44. In use, the tongue 30 is inserted through a fetter opening in the prisoner transport fetter 20, through the channel 44 in the pair of rigid handcuffs 40, and the predetermined distance into the lock opening 53—thereby preventing removal of the tongue 30 from the lock 50 and preventing separation of the pair of rigid handcuffs 40 from the prisoner transport fetter 20. This is illustrated in FIG. 3. Of course, the lock 50 can be unlocked as discussed below. In practice, the lock 50 can be unlocked allowing separation of the pair of rigid handcuffs 40 from the prisoner transport fetter 20, and the tongue can be reinserted the predetermined distance into the lock opening 53 retaining the prisoner transport fetter 20 in place. In that case, the prisoner remains encircled by the prisoner transport fetter 20 and remains handcuffed by the pair of rigid handcuffs 40, while there is more freedom of movement of the prisoner's handcuffed hands relative to the prisoner's body. The original condition can be restored quickly by unlocking the lock 50, inserting the tongue 30 through the channel 44 in the rigid pair of handcuffs 40, and inserting the tongue 30 the predetermined distance into the lock opening 53.

In some embodiments, the pair of rigid handcuffs 40 or a part of the pair of rigid pair of handcuffs 40 can be color-coded, so that the security organization that owns the pair of rigid handcuffs 40 can be identified quickly when custody of a prisoner is being transferred.

In some embodiments, the pair of rigid handcuffs 40 are formed with relatively light weight forged alloy cheek plates exhibiting superior strength and rigidity. For example, they may be die forged from a bar of a 7075 aluminum alloy, and hard coat anodized. This alloy is known for strength comparable to steel while maintaining light weight properties. The process may avoid the undesirable brittleness associated with die casting aluminum components. Impression die forging allows the cheek plates to be fabricated with radiused, curved, rounded, or beveled edges integrally formed during manufacture, without the necessity of separate steps such as post-forging machining or plastic over-molding. The curved, rounded edges are desirable to minimize potential injury to a wrist. The cheek plates of the right and left handcuffs 41 and 42 may be integral with a plate of the middle section 43, simplifying the manufacturing process, and may include reinforced layered portions of different thicknesses in the middle section 43. Such reinforced layered portions are not susceptible to bending where some prior art versions of rigid pairs of handcuffs are often weakest.

Different views of the lock 50 or of the lock 50 together with a tongue 30 are illustrated in FIGS. 7 through 16, FIG. 16 also showing a key 100.

Figure 8:
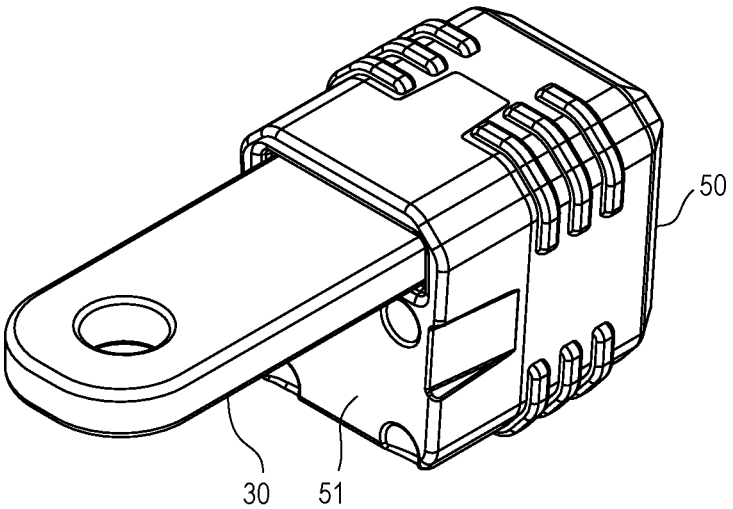
FIG. 8 is a tongue-face perspective view of a lock with a tongue inserted into the lock opening.
Figure 9:
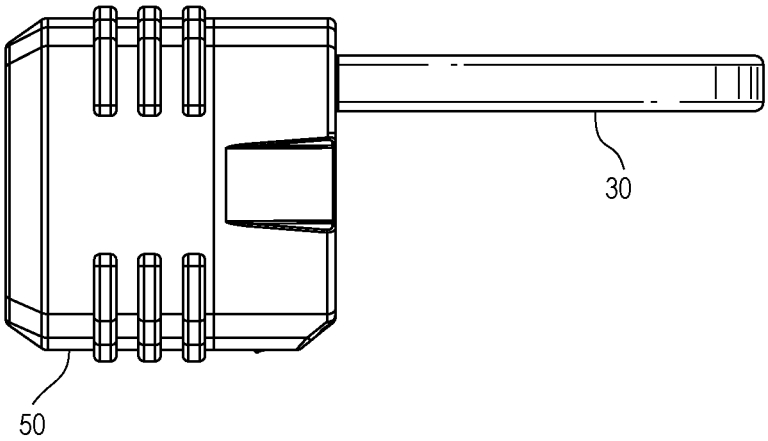
FIG. 9 is a side view of the lock with a tongue inserted into the lock opening.
Figure 10:
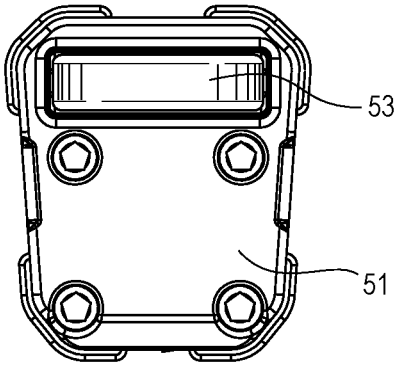
FIG. 10 is a tongue-face view of the lock.

In some embodiments and as illustrated, for example, in FIGS. 8 and 10, the lock 50 comprises a tongue-face 51 that defines a lock opening 53 that is dimensioned to accept a tongue 30 from a prisoner transport fetter 20. As discussed above, a locking mechanism 56 prevents removal of the tongue 30 from the lock 50 when the tongue is inserted a predetermined distance into the lock opening 53 and the locking mechanism 56 is in a locking position, which is its normal position in some embodiments as discussed below. In some embodiments, the lock opening 53 is substantially rectangular as seen, for example, in FIGS. 8, 10 and 16. For example, the lock opening 53 may be about three times as wide as it is high.

Figure 7:
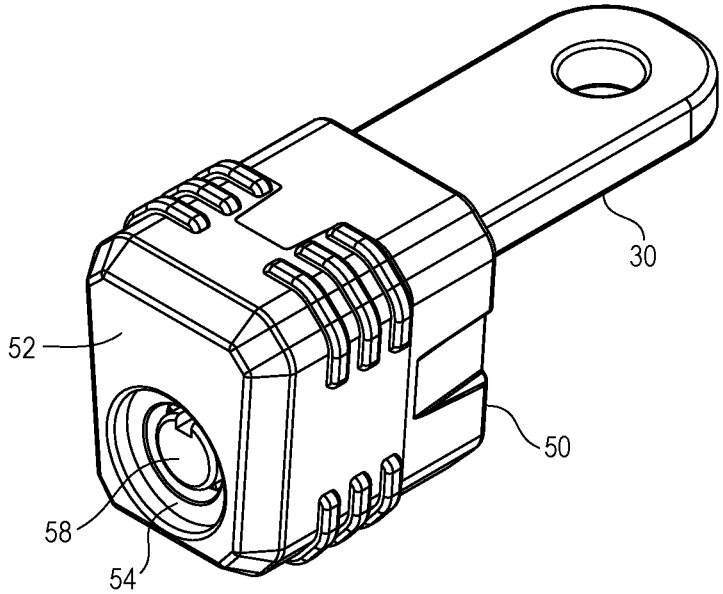
FIG. 7 is a keyhole-face perspective view of a lock, with a tongue inserted into the lock opening.
Figure 11:
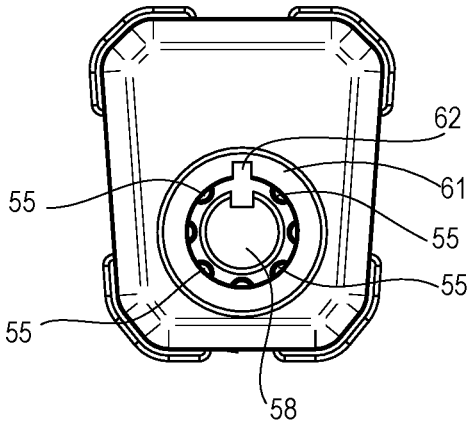
FIG. 11 is a keyhole-face view of the lock.
Figure 12:
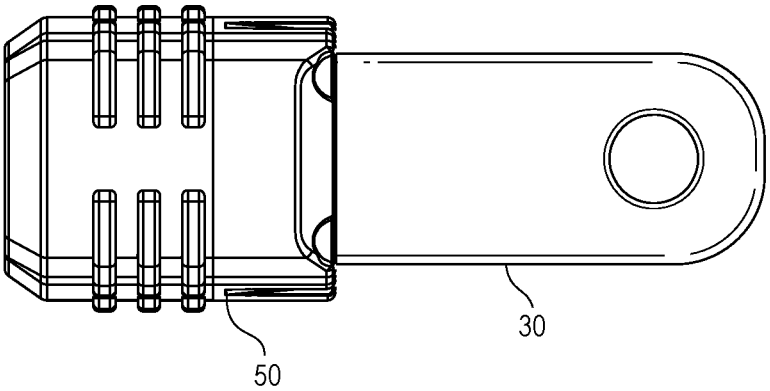
FIG. 12 is a bottom view of the lock with a tongue inserted into the lock opening.
Figure 13:
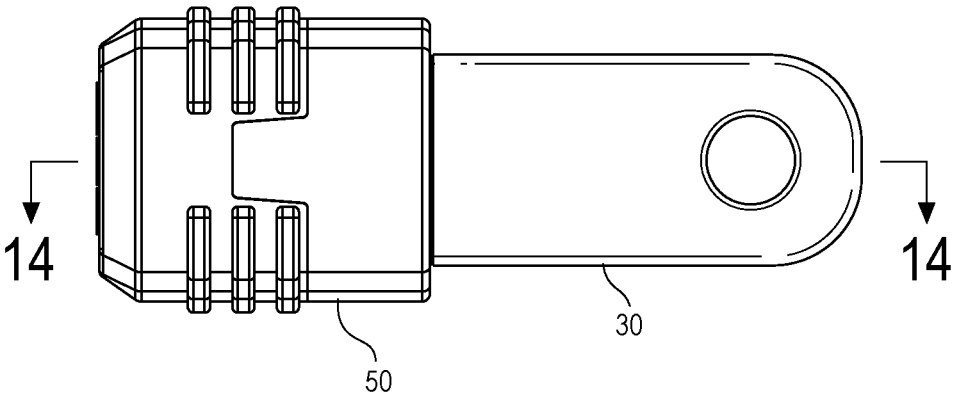
FIG. 13 is a top view of the lock with a tongue inserted into the lock opening.

In some embodiments and as illustrated, for example, in FIGS. 7 and 11, the lock 50 comprises a key-face 52 having a keyhole 54. The keyhole 54 is dimensioned to accept a key 100 that is adapted to engage the lock 50 and to move the locking mechanism 56 away from a locking position as shown, for example, in FIG. 15, to the position shown in FIG. 14, for example, allowing removal of the tongue 30 from the lock opening 56. As discussed above, the locking mechanism 56 may be biased in the locking position in some embodiments. For example, it may be spring biased as illustrated in FIGS. 14 through 16.

In some embodiments, the key-face 52 is a different face of the lock 50 than the tongue-face 51. In this way, the keyhole 54 may be easily accessible while the lock opening 53, through which one might attempt to insert a wire or other implement to trip the locking mechanism 56, is adjacent the pair of rigid handcuffs 40 and is inaccessible when in use.

In some embodiments, one end of the locking mechanism 56 is shaped to facilitate movement of the locking mechanism 56 away from the locking position and to allow entry of the tongue 30 into the lock opening 53 when the tongue 30 is initially being inserted into the lock opening 53. The wedge-shaped end 64 of the locking mechanism 56 illustrated, for example, in FIGS. 14 through 16 is an example of such a shaping. That end of the locking mechanism 56 also is shaped to facilitate movement of the locking mechanism 56 back to the locking position and to prevent removal of the tongue 30 from the lock opening 53 when the tongue 30 has been inserted the predetermined distance into the lock opening 53. The vertical surface 65 of the locking mechanism 56 illustrated, for example, in FIGS. 14 and 15 is an example of such a shaping.

In some embodiments, the lock 50 comprises an operator 58 for engagement with a key 100 when the key 100 is inserted into the keyhole 54. Multiple pins 55 of varying sizes and positions prevent engagement of the key 100 with the operator 58 unless sizes and positions of multiple indentations 101 around an edge of the key 100 align with the sizes and positions of the multiple pins 55, respectively. As there can be thousands of different combinations of pins 55 of varying sizes and positions, there will be thousands of different possible keys 100. Only a key 100 with indentations 101 that align respectively with the sizes and positions of the pins 55 of a particular lock 50 will be able to unlock that particular lock 50. This is seen best in FIG. 16.

In some embodiments, the operator 58 moves the locking mechanism 56 away from the locking position when the key 100 is engaged with the operator 58 and the key 100 is turned to an unlocked orientation with respect to the lock 50. In some embodiments, the locking mechanism 56 comprises an indentation 60 as seen, for example, in FIGS. 14 through 16. The operator 58 comprises a protrusion 59 that is located in the indentation 60. When the key 100 is engaged with the operator 58 and the key 100 is turned to an unlocked orientation with respect to the lock 50, the operator 58 rotates and the protrusion 59 moves the locking mechanism 56 away from the locking position. This is illustrated best in FIGS. 14 and 15.

In some embodiments, the lock 50 comprises a shield 61 to preclude removal of the key 100 from the lock 50 unless the key 100 is in a locked orientation with respect to the lock 50. In some embodiments, the shield 61 comprises a complete, or nearly complete, annular ring about an axis, and an interior edge of the complete annular ring, or opposing ends of the nearly complete annular ring, define a passageway 62 that extends in the direction of the axis. The key 100 comprises a key-protrusion 102, and the key 100 can pass through the shield 61 only when the key 100 is oriented so that the key-protrusion 102 is aligned with the passageway 62. These features are illustrated in FIGS. 11 and 16. The passageway 62 is located so that the key-protrusion 102 is aligned with the passageway 62 only when the key 100 is in the locked orientation with respect to the lock 50. In this way, the key 100 cannot be removed from the lock 50 if the lock 50 is unlocked.

Consequently, the tongue 30 may be inserted quickly into the lock opening 53 without a key and, if inserted the predetermined distance, the tongue 30 cannot be removed from the lock opening 53 unless the key 100 is inserted into the keyhole 54 and then turned to its unlocked orientation with respect to lock 50. The key 100 cannot be removed from the lock 50 unless the lock 50 is locked.

It will be understood that the disclosed prisoner transport kit can be modified without departing from the teachings of the invention. Accordingly, the scope of the invention is only to be limited as necessitated by the accompanying claims.

What is claimed is:

1. A prisoner transport kit, the kit comprising:
a pair of rigid handcuffs;
a lock; and
a prisoner transport fetter;
the lock comprising:
a tongue-face defining a lock opening that is dimensioned to accept a tongue from the prisoner transport fetter;
a locking mechanism which prevents removal of the tongue from the lock opening when the tongue is inserted a predetermined distance into the lock opening and the locking mechanism is in a locking position; and
a key-face having a keyhole, the key-face being a different face of the lock than the tongue-face, the keyhole being dimensioned to accept a key that is adapted to engage the lock and to move the locking mechanism from the locking position, thereby allowing the removal of the tongue from the lock opening;
the prisoner transport fetter having first and second opposing ends, the fetter comprising:
the tongue, the tongue being located at the first end of the fetter and comprising a locking feature, the locking feature engaging with the locking mechanism when the tongue is inserted the predetermined distance into the lock opening and the locking mechanism is in the locking position; and
a plurality of fetter openings spaced apart from each other along a length of the fetter, wherein the tongue can be inserted through one of the fetter openings before being inserted into the lock opening; and
the pair of rigid handcuffs defining a channel that is dimensioned to allow the tongue to pass through the channel but not to allow the lock to pass through the channel.

2. The prisoner transport kit of claim 1, further comprising an attaching mechanism at the second end of the fetter, the attaching mechanism being capable of attaching the second end of the fetter to one of the fetter openings.

3. The prisoner transport kit of claim 2, wherein
the fetter comprises a chain;
spaces defined by links of the chain comprise the fetter openings; and
the attaching mechanism comprises a clip.

4. The prisoner transport kit of claim 3, wherein the chain comprises stainless steel.

5. The prisoner transport kit of claim 2, wherein
the fetter comprises a fiber belt;
button holes in the belt comprise the fetter openings; and
the attaching mechanism comprises a button.

6. The prisoner transport kit of claim 5, wherein the fiber belt is stretch-resistant, abrasion-resistant, and cut-resistant.

7. The prisoner transport kit of claim 5, where fiber of the fiber belt is selected from a group consisting of aramid and ultra-high-molecular-weight polyethylene.

8. The prisoner transport kit of claim 5, where the fiber belt is a polyester webbing.

9. The prisoner transport kit of claim 1, the locking feature comprising an opening in the tongue.

10. The prisoner transport kit of claim 1, the locking feature comprising a protrusion depending from a remainder of the tongue.

11. The prisoner transport kit of claim 1, further comprising another tongue at the second end of the fetter, the other tongue comprising a locking feature that is structured and dimensioned to engage with a locking mechanism of another lock when the other tongue is inserted the predetermined distance into a lock opening of the other lock and the locking mechanism of the other lock is in a locking position.

12. The prisoner transport kit of claim 11, further comprising the other lock.

13. The prisoner transport kit of claim 11, further comprising:

a pair of ankle cuffs; and a center ring, each one of the pair of ankle cuffs being chained to the center ring, and the center ring being large enough for the other tongue at the second end of the fetter to pass through the center ring;

wherein the second tongue can be inserted through a selected one of the fetter openings before being inserted into the lock opening of the other lock, and the fetter is long enough to encircle a prisoner's torso, with the tongue at the first end of the fetter inserted through one of the fetter openings before being inserted into the lock opening of the lock, and for the other tongue at the second end of the fetter to pass through the center ring before being inserted through the selected one of the fetter openings before being inserted into the lock opening of the other lock.

14. A prisoner transport fetter having first and second opposing ends, the fetter comprising:

a tongue located at the first end of the fetter and comprising a locking feature, the tongue having a length axis greater than a width axis, the width axis being greater than a height axis, the tongue having a first area in a plane defined by the length axis and the width axis, the locking feature having a second area in the plane, the first area being at least three times greater than the second area, and the locking feature being structured and dimensioned to engage with a locking mechanism of a lock when the tongue is inserted a predetermined distance into a lock opening of the lock while the locking mechanism is in a locking position; and a plurality of fetter openings spaced apart from each other along a length of the fetter, wherein the tongue can be inserted through one of the fetter openings before being inserted into the lock opening.

15. The prisoner transport fetter of claim 14, further comprising an attaching mechanism at the second end of the fetter, the attaching mechanism being capable of attaching the second end of the fetter to one of the fetter openings.

16. The prisoner transport fetter of claim 15, wherein the fetter comprises a chain;

spaces defined by links of the chain comprise the fetter openings; and the attaching mechanism comprises a clip.

17. The prisoner transport fetter of claim 16, wherein the chain comprises stainless steel.

18. The prisoner transport fetter of claim 15, wherein the fetter comprises a fiber belt;

button holes in the belt comprise the fetter openings; and the attaching mechanism comprises a button.

19. The prisoner transport fetter of claim 18, wherein the fiber belt is stretch-resistant, abrasion-resistant, and cut-resistant.

20. The prisoner transport fetter of claim 18, where fiber of the fiber belt is selected from a group consisting of aramid and ultra-high-molecular-weight polyethylene.

21. The prisoner transport fetter of claim 18, where the fiber belt is a polyester webbing.

22. The prisoner transport fetter of claim 14, the locking feature comprising an opening in the tongue.

23. The prisoner transport fetter of claim 14, the locking feature comprising a protrusion depending from a remainder of the tongue.

24. The prisoner transport fetter of claim 14, further comprising another tongue located at the second end of the fetter and comprising a locking feature that is structured and dimensioned to engage with a locking mechanism of another lock when the other tongue is inserted the predetermined distance into a lock opening of the other lock and the locking mechanism of the other lock is in a locking position.

* * * * *